US006323381B1

(12) United States Patent
Nacamuli et al.

(10) Patent No.: US 6,323,381 B1
(45) Date of Patent: Nov. 27, 2001

(54) MANUFACTURE OF HIGH PURITY BENZENE AND PARA-RICH XYLENES BY COMBINING AROMATIZATION AND SELECTIVE DISPROPORTIONATION OF IMPURE TOLUENE

(75) Inventors: Gerald J. Nacamuli, Mill Valley; Robert A. Innes, San Rafael; Arnold J. Gloyn, Walnut Creek, all of CA (US)

(73) Assignee: Chevron Corporation, San Ramon, CA (US)

( * ) Notice: Subject to any disclaimer, the term of this patent is extended or adjusted under 35 U.S.C. 154(b) by 0 days.

(21) Appl. No.: 08/273,933

(22) Filed: Jul. 12, 1994

Related U.S. Application Data

(63) Continuation-in-part of application No. 08/120,632, filed on Sep. 13, 1993, now abandoned, which is a continuation of application No. 07/952,312, filed on Sep. 28, 1992, now abandoned, which is a continuation of application No. 07/900,857, filed on Jun. 18, 1992, now abandoned.

(51) Int. Cl.[7] ..... C07C 6/00; C07C 15/04; C07C 15/08

(52) U.S. Cl. ..... 585/475; 585/312; 585/322

(58) Field of Search ..... 585/475, 312, 585/322

(56) References Cited

U.S. PATENT DOCUMENTS

| | | | | |
|---|---|---|---|---|
| 3,957,621 | * | 5/1976 | Bonacci et al. | 585/475 |
| 4,016,219 | * | 4/1977 | Kaeding | 585/475 |
| 4,052,476 | * | 10/1977 | Morrison | 585/475 |
| 4,067,919 | * | 1/1978 | Butter | 585/475 |
| 4,097,543 | * | 6/1978 | Haag et al. | 585/475 |
| 4,160,788 | * | 7/1979 | Young | 585/475 |
| 4,720,602 | * | 1/1988 | Chu | 585/415 |
| 4,891,463 | * | 1/1990 | Chu | 585/415 |
| 4,962,257 | * | 10/1990 | Absil et al. | 585/475 |

* cited by examiner

*Primary Examiner*—Elizabeth D. Wood
(74) *Attorney, Agent, or Firm*—Thomas G. DeJonghe; Charles W. Stewart

(57) ABSTRACT

A process is set forth for reacting impure toluene to obtain benzene, toluene and a para-rich xylene stream, which are substantially free of close-boiling non-aromatics. The impure toluene comprises at least 70 wt % toluene and between about 0.2 wt % and about 5 wt % close-boiling non-aromatics. The process may also comprise aromatizing a naphtha over a non-acidic catalyst. The impure toluene from the aromatization step is passed over an acidic intermediate pore zeolite to produce a para-rich xylene stream and chemically pure benzene.

19 Claims, 3 Drawing Sheets

MANUFACTURE OF HIGH PURITY BENZENE AND PARA-RICH XYLENES BY COMBINING AROMATIZATION AND SELECTIVE DISPROPORTIONATION OF IMPURE TOLUENE

CROSS REFERENCE

This application is a Continuation of Ser. No. 07/952,312, filed Sep. 28, 1992 and now abandoned, which is a continuation-in-part of application Ser. No. 08/120,632, filed Sep. 13, 1993, now abandoned, which is a continuation of Ser. No. 07/900,857, filed Jun. 18, 1992 and now abandoned.

TECHNICAL FIELD

The invention described herein contemplates production of high purity benzene and para-xylene rich xylenes, and if desired of chemically pure toluene as well, from an impure toluene stream containing nonaromatic impurities boiling in the benzene-toluene-xylene (BTX) range by using an acidic para-selective catalyst. Also contemplated is an aromatization step using a substantially nonacidic catalyst followed by use of an acidic para-selective catalyst on the product stream from the aromatization or on the toluene containing fraction therefrom to produce high purity benzene and a para-xylene enriched xylene stream which is substantially free of nonaromatic impurities, and, if desired, chemically pure toluene.

BACKGROUND OF THE INVENTION

The disproportionation of pure toluene feedstocks over molecular sieve catalysts to produce xylenes and benzene is a known phenomenon. The use of para-selective catalysts which make a xylene product containing a greater than thermodynamic equilibrium ratio of para-xylene to ortho- and meta-xylene is described, for example, in U.S. Pat. Nos. 4,117,026 and 4,097,543 of Haag and Olson.

It has been the practice to specify and use only high purity toluene as the feed for both conventional and para-selective toluene disproportionation processes. High purity toluene is usually made by extracting the aromatic compounds from a reformate or pyrolysis gas fraction and then distilling the aromatics in several steps to recover substantially pure benzene, toluene and $C_8$ aromatics.

Toluene recovered directly from reformate or pyrolysis gasoline by distillation without prior extraction typically contains several percent close boiling nonaromatics. Non-extracted toluene has not been considered as an acceptable feed for the toluene disproportionation process because in the prior art processes the nonaromatic impurities have led to decreased benzene and xylene yields and to decreased purity for the products. Thus, the production of benzene and xylene via toluene disproportionation has required a prior aromatics extraction step which has added significantly to the cost of the final benzene and xylene products.

Catalysts can be used to selectively remove nonaromatics from reformates. For example, U.S. Pat. No. 3,849,290 describes a multi-step process to upgrade the octane rating of a naphtha gasoline blending stock. In a first step, the stock is reformed over a nonacidic platinum-type catalyst, producing a reformate containing aromatics and paraffins. The reformate is then contacted under mild hydrocracking conditions with an intermediate pore zeolite to selectively crack high boiling, low octane paraffins, e.g., $C_7$+. The effluent from this hydrocracking step is contacted with a small pore catalyst to selectively hydrocrack low boiling, low octane $C_6$− paraffins. This three step, three catalyst processing sequence yields a high octane product after the preferential removal of low octane species, but the product purity is insufficiently high for petrochemical applications.

U.S. Pat. No. 4,795,550 describes a low temperature catalytic process for removing olefinic impurities, but not paraffins or naphthenes, from an aromatic stream having a bromine index between 50 and 2000.

U.S. Pat. No. 4,150,061 describes a process whereby a fractionated pyrolysis gasoline comprising toluene, xylenes, ethylbenzenes, $C_7$–$C_{10}$ paraffins, olefins and naphthenes are selectively hydrodealkylated and transalkylated to give ethylbenzene-lean xylenes and benzene in the presence of a catalyst comprising a tungsten/molybdenum component ($WO_3$—$MoO_3$) and an acidic component of 60 wt % mordenite and 40 wt % catalytically active alumina. The product is then distilled to provide benzene and xylene streams of unknown purity and a toluene stream for recycle.

U.S. Pat. No. 4,861,932 describes a process for producing gasoline blending stocks in which nonaromatic $C_2$–$C_{12}$ paraffins are converted to a mixture of higher octane aromatics and alkylaromatics by first contacting the paraffins with a noble metal/low acidity catalyst. The effluent is then contacted with an acidic catalyst based on a zeolite such as ZSM-5 with a metal such as gallium (Ga). Although the Ga/ZSM-5 catalyst is known to have a high aromatic selectivity, the product purity is insufficiently high for petrochemical applications.

A large number of molecular sieves are known to have use as catalysts in various hydrocarbon conversion reactions such as disproportionation, aromatization including reforming, catalytic cracking, hydrocracking, dehydrocyclization, isomerization and dewaxing. Typical intermediate pore size molecular sieves of this nature include ZSM-5, silicalite, generally considered to be a high silica to alumina ratio form of ZSM-5, ZSM-11, ZSM-22, ZSM-23, ZSM-35, SSZ-32, SAPO-11, SAPO-31, SAPO-41, and the like. Zeolites such as ZSM-5, ZSM-11, ZSM-12, ZSM-23, ZSM-35 and ZSM-38 are described in U.S. Pat. Nos. 3,700,585; 3,894,938; 3,849,290; 3,950,241; 4,032,431; 4,141,859 4,176,050; 4,181,598; 4,222,855; 4,229,282; and 4,247,388 and in British Patent 1,469,345. However, the use of such catalysts, particularly acidic and para-selective forms of such catalysts, for the production of high purity benzene and para-xylene enriched xylene products from a $C_7$-rich aromatization product, is not known and has generally not been contemplated.

It would be highly advantageous if one could use refinery streams, for example, aromatizer product streams which had at most been distilled so as to have a reasonably high toluene content, but which still had a significant amount of impurities which boiled in the toluene range, in a process which would selectively produce para-xylene enriched xylene along with benzene, and if desired chemically pure toluene as well and would at the same time convert the impurities to products which could be readily separated from the para-xylene enriched xylene and the benzene and from toluene, if desired, by simple distillation.

DISCLOSURE OF INVENTION

The present invention is directed to overcoming one or more of the problems as set forth above.

In accordance with an embodiment of the invention a process is provided for the selective production of a benzene and para-xylene-rich product which is substantially free of close-boiling nonaromatics. The product is produced from a feed which comprises at least about 70% toluene and between at least about 0.2 wt % and 5 wt % close-boiling nonaromatics. The process comprises contacting the feed with an acidic para-selective catalyst to produce the desired product.

In accordance with other embodiments of the invention a predominantly paraffinic feed is aromatized over a substantially nonacidic catalyst. A stream having at least 70% toluene and at least about 0.2 wt % but no more than about 5 wt % close-boiling nonaromatics is obtained. The stream is used as the toluene-containing feed. Alternatively, an aromatizer product stream which may not have sufficient toluene can be distilled to produce the toluene-containing feed. In either case the feed is contacted with an acidic para-selective catalyst to produce the product.

It has been surprisingly discovered that para-selective catalysts, which selectivation would be expected to have reduced cracking and other activities, can be prepared and utilized under conditions such that they will, along with selectively producing para-xylene, also convert close-boiling nonaromatics to products which are not close-boiling to benzene or to the xylene isomers or to toluene whereby simple distillation can be utilized to provide chemical grade benzene and xylene (and toluene) fractions. It is also surprising that a $C_7$ product stream or fraction from an aromatizer unit has a low enough concentration of close boiling nonaromatics such that an acidic para-selective catalyst can convert sufficient of the close boiling nonaromatics to compounds boiling outside the BTX range readily separable by distillation and at the same time selectively convert the toluene to a para-xylene enriched stream and benzene.

BRIEF DESCRIPTION OF DRAWINGS

The invention will be better understood by reference to the figures of the drawings wherein like numbers denote like parts throughout and wherein.

DETAILED DESCRIPTION OF THE INVENTION

Figure 1:
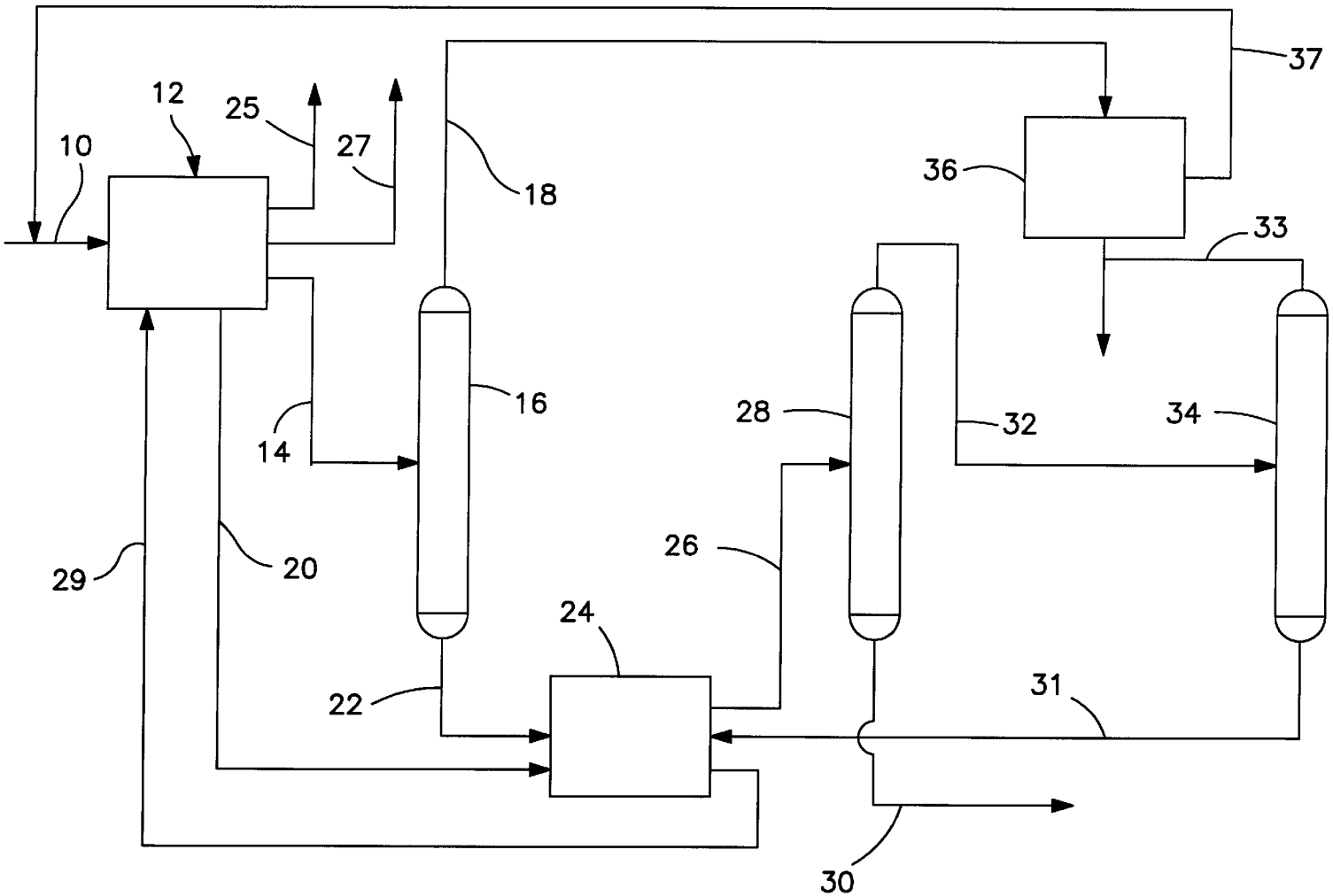
FIG. 1 illustrates, schematically, a process in accordance with an embodiment of the invention.

In one embodiment of the present invention, high purity benzene and para-xylene-rich xylenes can be made from an impure toluene stream by using an intermediate pore size acidic para-selective catalyst with high cracking activity, such as HZSM-5 which has been treated to make it para-selective. Under toluene disproportionation conditions close-boiling nonaromatic impurities comprising up to 5 wt % of the toluene feedstream are converted, enabling the recovery by distillation of benzene and any remaining toluene (which can be recycled), both of which are 99.5 wt %, more preferably 99.8 wt % and still more preferably 99.9 wt % pure. (Terms such as of high purity, close-boiling nonaromatics-substantially free, chemically pure or of chemical grade are sometimes used herein to indicate 99.5 wt % or better purity of the benzene and toluene products.) In this manner, a toluene containing aromatizer product or a distillation fraction thereof, can be directed to a reactor where a process according to the present invention is carried out, bypassing an aromatics extraction step. The impure toluene stream, in vapor phase, can be reacted over the acidic para-selective catalyst to ultimately yield high purity benzene and xylene streams. The xylenes stream produced by disproportionation in accordance with the invention followed by distillation, has no more than about 0.5 wt %, preferably no more than about 0.2 wt % and more preferably no more than about 0.1 wt % of close-boiling nonaromatics. It will generally comprise a $C_{8+}$ fraction containing ethylbenzene. Such a stream is sometimes referred to herein as a high purity xylene fraction which is para-xylene enriched.

The principal aim of the present invention is to produce high purity benzene and a high purity xylene fraction which is para-xylene enriched by selectively reacting out nonaromatic impurities having boiling points in the benzene and xylene boiling ranges while producing the desired products from an impure toluene stream. The separation of the product is accomplished by non-extractive, e.g., distillative, techniques.

The benzene to xylene (BTX) boiling range generally covers temperatures between about 140° F. and 350° F. (about 60° C. and 180° C.). Nonaromatics (paraffins, olefins and naphthenes) boiling in this temperature range are referred to herein as close-boiling nonaromatics.

The process in general involves cracking the close-boiling nonaromatics by their selective reaction over an acidic catalyst during the selective production of para-xylene. The close-boiling nonaromatics are converted to light paraffins, olefins and other compounds boiling substantially outside the BTX boiling range whereby they can be readily separated by simple distillation.

The term "nonextractive" is used herein to mean that separation of hydrocarbon species is achieved on the basis of differences in boiling point as opposed to reliance on a solvent. As a result of these nonextractive techniques, the purity of the benzene and toluene produced is preferably at least about 99.5 wt %, more preferably at least about 99.8 wt % and most preferably at least about 99.9 wt %. The high purity xylene fraction which is para-xylene enriched has no more than about 0.5 wt %, preferably no more than about 0.2 wt % and more preferably no more than about 0.1 wt % of close-boiling nonaromatics. These aromatic products are referred to herein as substantially free of nonaromatic impurities.

Catalyst acidity is essential to the conversion of the nonaromatic impurities in the toluene disproportionation step. As is known in the art, one measure of catalyst acidity is n-hexane cracking activity. For example, according to the "alpha" test, $\alpha$ represents the relative n-hexane cracking activity of a catalyst compared with a standard catalyst. The test is described more fully in U.S. Pat. No. 3,354,078, the *Journal of Catalysis*, Vol. 6, p. 522–529, (August 1965) and the *Journal of Catalysis*, Vol. 61, p. 395 (1980), each of which are incorporated herein by reference.

According to the test, a catalyst is "acidic" if $\alpha$ is greater than about 10, or more preferably, is greater than about 50. Highly acidic catalysts have $\alpha$ values greater than about 100. Acidic catalysts that are useful in the present invention are characterized by this definition of acidity, i.e., $\alpha$ greater than about 10, more preferably greater than about 50 and still more preferably greater than about 100.

Zeolites can be characterized by their absorption characteristics at relatively low temperatures, for example from 77° K to 420° K, as described in , for example, Zeolite Molecular Sieves, Donald W. Breck, First Edition, John Wiley & Sons, 1974. These absorption characteristics are a function of the kinetic diameters of the particular molecule being absorbed and of the channel dimensions of the molecular sieve. Intermediate pore size molecular sieves useful in the practice of the invention in the H-form will typically admit molecules having kinetic diameters of 5.0 to 6.0 Å with little hindrance. Examples of such compounds (and their kinetic diameters in Å) are: n-hexane (4.3), 3-methylpentane (5.5), benzene (5.8), and toluene (5.8). Compounds having kinetic diameters of about 6.0 to 6.8 Å can be admitted into the pores, depending on the particular sieve, but do not penetrate as quickly and in some cases are effectively excluded. Compounds having kinetic diameters in the range of 6.0 to 6.8 Å include: cyclohexane (6.0), 2,3-dimethylbutane (6.1), 2,2-dimethylbutane (6.2), m-xylene (6.1) 1,2,3,4-tetramethylbenzene (6.4) and o-xylene (6.8). Generally, compounds having kinetic diameters of greater than about 6.8 Å do not penetrate the pore apertures and thus are not absorbed into the interior of the molecular sieve lattice. Examples of such larger compounds include: hexamethylbenzene (7.1), 1,3,5-trimethylbenzene (7.5), and tributylamine (8.1).

Specific molecular sieves which are useful in the process of the present invention include the zeolites ZSM-5, ZSM-11, ZSM-12, ZSM-21, ZSM-22, ZSM-23, ZSM-35, ZSM-38, ZSM-48, ZSM-57, SSZ-23, SSZ-25, SSZ-32, and other molecular sieve materials based upon aluminum and/or magnesium phosphates such as SAPO-11, SAPO-31, SAPO-41, MAPO-11 and MAPO-31. Such molecular sieves are described in the following publications, each of which is incorporated herein by reference: U.S. Pat. Nos. 3,702,886; 3,709,979; 3,832,449; 3,950,496; 3,972,983; 4,076,842; 4,016,245; 4,046,859; 4,234,231; 4,440,871 and U.S. patent applications Ser. No. 172,730 filed Mar. 23, 1988 and Ser. No. 433,382, filed Oct. 24, 1989. In most cases, these molecular sieves must be further treated to impart para-selectivity as discussed below.

The sieves are preferably bound with any of a variety of well-known inorganic oxide binders. Appropriate binders include inorganic compositions with which the molecular sieve can be combined, dispersed or otherwise intimately admixed. Preferred oxide binders include alumina, silica, naturally occurring and conventionally processed clays, for example, bentonite, kaolin, sepiolite, attapulgite and halloysite.

The selective conversion of nonaromatics in an aromatics-rich stream is performed in the vapor state. In general, reaction conditions should be such as to promote the preferential catalytic conversion of the nonaromatics while still accomplishing the desired conversion of toluene to benzene and a xylene fraction enriched in para-xylene. Generally, the pressure should be between about 30 and 1000 psig, preferably from about 100 to about 600 psig. Suitably the temperature is between about 700° F. and 1,200° F., preferably between about 800° F. and about 1,000° F. The feed weight hourly space velocity may suitably be from about 0.1 to about 10, preferably from about 1 to about 8, more preferably from about 2 to about 6. The process is carried out in the presence of hydrogen to inhibit fouling. The molar ratio of hydrogen to hydrocarbon feed is typically between about 0.5 and about 10.0 and is preferably between about 2 and about 5. The Examples that follow illustrate suitable operating parameters.

The processes of the present invention may be used to make high purity aromatics streams from a variety of toluene containing feeds which have a toluene content of 70 wt % or more, preferably 80 wt % or more and more preferably at least about 90 wt %. This serves to minimize production of light gases and enhance both the cost-effectiveness of the process of the present invention and its suitability for use with the processes described herein. Typical feeds for various embodiments of the invention include aromatizer product streams, and fractions and mixtures, generally made from $C_5$–$C_{11}$ feedstocks (to the aromatizer), $C_6$–$C_8$ feedstocks, $C_6$–$C_7$ feedstocks and $C_7$ feedstocks. The aromatizer product streams (or the toluene distillation cuts from them) will include at least about 0.2 wt %, usually at least about 0.3 wt % and may include up to but not more than about 5 wt %, of close-boiling nonaromatics. The aromatizer product streams (or the toluene distillation cuts from them) can also include up to about 25 wt % of aromatics other than toluene, e.g., benzene and ethylbenzene. Indeed, one advantage of the present invention is that a portion of the ethylbenzene is converted to benzene and/or xylenes during toluene disproportionation.

In one embodiment, a toluene fraction of a reformate or aromatizer product stream obtained by reforming or aromatizing a $C_6$–$C_7$ feed is purified and simultaneously disproportionated to produce benzene and a xylene fraction which is enriched in para-xylene by reaction over a acidic para-selective catalyst. Such a feed could be a light naphtha feed, for example, one rich in $C_6$ and/or $C_7$ components, reformed or aromatized over any of a variety of conventional reforming or aromatization catalysts to produce a product stream containing benzene, toluene and close-boiling nonaromatics. Exemplary reforming and aromatizing process conditions include: feed rate of 0.1–10 WHSV, pressures between about 0 psig and about 200 psig, preferably between about 40 psig and about 100 psig, temperatures between about 800° F. and 1100° F., and a hydrogen:feed molar ratio of between about 0.1–10. The reformate or aromatizer product stream is suitably distilled to produce the feedstock to the selective para-xylene production process.

Preferably the process used on the naphtha feed is aromatization using a nonacidic catalyst. The $\alpha$ values of the non-acidic catalyst used in the aromatization step should be less than 0.1. Catalyst acidity in aromatics generation is undesirable because it promotes cracking that in turn results in lower aromatic selectivity. Also, the amounts of close boiling nonaromatics is kept to acceptable limits as defined above if the acidity of the reforming or aromatization catalyst is kept sufficiently low. To reduce acidity, the catalyst may contain an alkali metal and/or an alkaline earth metal. The alkali or alkaline earth metals are preferably incorporated into the catalysts during or after synthesis according to conventional methods. In addition, at least 90% of the acid sites are desirably neutralized by introduction of these metals, more preferably at least 95%, most preferably substantially 100%.

In addition, the catalyst for aromatics generation may be based on alumina or molecular sieves, such as L-zeolite or silicalite, with an inorganic binder. Preferred catalysts for aromatization include catalysts comprising platinum on nonacidic forms of beta-zeolite, ZSM-5, silicalite and L-zeolite. Other well-known aromatization catalysts typically contain a catalytic metal such as platinum disposed on any of a plethora of natural and man-made crystalline aluminosilicates. Metallic promoters such as platinum or other Group VIII metals also may be included, as can other promoter metals. The preferred aromatization catalyst is L-zeolite.

Examples of methods of manufacture of ZSM-5, and particularly of a ZSM-5 catalyst having high silica-alumina ($SiO_2$:$Al_2O_3$) molar ratio, sometimes referred to as silicalite, are shown in: Dwyer, et al., U.S. Pat. No. 3,941,871, issued Mar. 2, 1976 and U.S. Pat. No. 4,441,991, issued Apr. 10, 1984; and Derouane, et al., EPO Application No. 186,479, published Feb. 7, 1986, all of which are incorporated by reference in their entireties.

Examples of the preparation of nonacidic platinum on silicalite or L-zeolite catalysts may be found in U.S. Pat. Nos. 4,830,732 and 5,073,250, both of which are incorporated herein in their entireties by reference.

Low sulfur feeds to the aromatics generation step may be particularly attractive in order to avoid poisoning the catalyst. In the case of L-zeolite, it is preferable that the feed to the aromatizer has a sulfur content of less than 50 ppbw, and more preferably less than 5 ppbw.

As a specific example of the employment of such an aromatics generation procedure with the process of the present invention, valuable $C_6$–$C_8$ aromatics may be produced from relatively inexpensive hydrocarbon feeds such as paraffinic naphthas. The products are streams containing ethylbenzene, benzene, toluene, and the three xylene isomers. A distillation step may be carried out to produce a fraction having a desired toluene content, e.g., 70 wt % or higher. The aromatics generation procedure converts the hydrocarbon feedstocks into very clean aromatic mixtures that, however, include a limited amount of close-boiling nonaromatic impurities boiling in the toluene boiling range. The amount of nonaromatic impurities boiling in the toluene boiling range in a $C_7$+ cut of product must fall within the range from 0.2 wt % to 5 wt %, preferably from 0.2 wt % to 2 wt %. The process according to the present invention then simultaneously produces benzene and a para-rich xylene stream, and converts the close-boiling nonaromatic impurities to yield products that are substantially free of close-boiling nonaromatics. Thus, in some embodiments the process uses two separate catalysts: a nonacidic catalyst to generate aromatics and an acidic catalyst to purify the aromatics generated and to simultaneously convert the toluene present into a chemically pure xylene fraction which is enriched in para-xylene and into chemically pure benzene.

More particularly, such a process could involve passing an inexpensive hydrocarbon feed over a nonacidic catalyst such as platinum on L-zeolite or on silicalite (which is generally considered to be a ZSM-5 zeolite with a low alumina content, e.g., ZSM-5 with a silica to alumina ratio of at least 1,000). Such catalysts are especially effective at aromatizing the feed, but, as described above, produce a complex mixture containing a limited amount of nonaromatics that are difficult to separate by distillation from the desired aromatics.

Next, an acidic para-selective catalyst cleans up the mixture by converting the close-boiling nonaromatic components into both lighter and heavier components that can be easily separated from the aromatics, for example, by distillation, while selectively converting the toluene to chemically pure benzene and to a $C_8$ aromatics fraction having an enhanced para-xylene content and which is substantially free of nonaromatics. This beneficial combination of two different catalysts serves to facilitate the production of high purity benzene and xylenes.

Some of the ethylbenzene present in the feed to the toluene disproportionation step is converted to benzene and/or xylenes, while the remaining (i.e., unconverted) fraction can be conventionally handled by feeding the $C_8$ fraction to a para-xylene plant wherein para-xylene is separated from the other $C_8$ aromatics by crystallization or by selective adsorption.

Substantially any catalyst which is para-selective can be used in the process of the present invention so long as it has enough acidity. Examples of such catalysts are found in previously mentioned U.S. Pat. Nos. 4,117,026 and 4,097,543 of Haag and Olson, both of which are incorporated herein in their entireties by reference. In general, the term "para-selective" as used herein means that the catalyst, when used in accordance with the present invention will produce a xylene fraction in which at least 40% of the xylenes are para-xylene. Indeed, as is shown in the examples well over 60% of the xylenes produced can be para-xylene. Attaining such a higher percentage of para-xylene is generally desirable.

The use of large crystal size zeolites having a minimum crystal dimension of greater than about 0.5 micron, generally in the approximate range of 1–20 microns and particularly 1–6 microns is generally preferred as adding to the para-selectivity. In a preferred embodiment, the specified large crystal size zeolite modified by precoking or combination therewith of one or more difficulty reducible oxides is employed.

In assessment of zeolite crystal size, conventional scanning electron microscopy (SEM) techniques can be used, the minimum crystal dimension of a given crystal being taken as the dimension of reference. The crystalline aluminosilicate zeolites used in the present invention in substantial proportion are essentially characterized by a minimum crystal dimension of greater than about 0.5 micron. It is contemplated that the amount of zeolite of such crystal size will be such as to exert a directive influence in the desired selective production of paradialkyl substituted benzenes. Generally, the amount of zeolite of such crystal size will be present in predominate proportion, i.e., in an amount exceeding 50 weight percent, and preferably may constitute up to 100 weight percent of the total zeolite employed.

In the preferred embodiment, the crystalline aluminosilicate zeolites employed, particularly those having a minimum crystal dimension of greater than about 0.5 micron, may have undergone modification prior to use by selective precoking thereof to deposit at least about 1 weight percent and generally between about 2 and about 40 weight percent of coke thereon, based on the weight of total catalyst. If the zeolite is employed in substantially pure form or in combination with a low coking binder, such as silica, then the weight percent of coke is generally in the range of 2 to 20 weight percent. When the zeolite is combined with a binder of high coking tendencies, such as alumina, coke content of the total catalyst is in the approximate range of 10 to 40 weight percent. Precoking can be accomplished by contacting the catalyst with a hydrocarbon charge, e.g., toluene, under high severity conditions at a reduced hydrogen to hydrocarbon concentration, i.e., 0 to 1 mole ratio of hydrogen to hydrocarbon for a sufficient time to deposit the desired amount of coke thereon. Prior modification of the zeolite may also be suitably effected by combining therewith an amount, generally in the range of about 2 to about 30 weight percent, of a difficulty reducible oxide such as an oxide of antimony, phosphorous, boron and/or magnesium. Combination of the desired oxide with the zeolite can readily be effected by contacting the zeolite with a solution of an appropriate compound of the element to be introduced, followed by drying and calcining to convert the compound to its oxide form.

ZSM-5 is the preferred catalyst for the disproportionation reaction. The ZSM-5 preferably has a silica to alumina mole ratio of between 10 and 100.

The conversion process described herein is generally carried out as a semi-continuous or continuous operation utilizing a fixed or moving bed catalyst system.

The present invention will be more clearly understood by reference to the following examples.

EXAMPLE 1

Comparison Example with Non-selectivated Catalyst

Debutanized reformate prepared by reforming of a full boiling range naphtha feedstock over a catalyst comprising platinum on alumina and was distilled to obtain light and heavy fractions. The heavy reformate was further distilled to a 30% cut point. The overhead product of the second distillation, comprising about 92 wt % toluene and about 5 wt % nonaromatics, was vaporized, blended with hydrogen, and passed through a tubular fixed-bed reactor charged with acidic but not selectivated ZSM-5 catalyst. The reaction was carried out at 1000° F. (538° C.), 150 psig, and 5.7 liquid toluene feed weight hourly space velocity (WHSV). The added hydrogen:toluene molar ratio was about 3:1.

Feed and product analyses were obtained by capillary gas-liquid chromatography after nine hours on stream, as shown in Table 1. The gas chromatograph was equipped with a flame ionization detector and a polar column that eluted nonaromatics before aromatics.

TABLE 1

| Components | Feed Area % | Product Area % | Difference |
|---|---|---|---|
| Nonaromatics: | | | |
| C1–C5 | 0.008 | 5.536 | 5.536 |
| isohexanes | 0.002 | 0 | −0.002 |
| n-hexane | 0.001 | 0 | −0.001 |
| C6–C7 nonaromatics | 0.092 | 0 | −0.092 |
| n-heptane | 0.334 | 0 | −0.334 |
| C7–C8 nonaromatics | 2.044 | 0.009 | −2.035 |
| n-octane | 0.933 | 0 | −0.933 |
| C8–C9 nonaromatics | 1.423 | 0.116 | −1.307 |
| C9 + nonaromatics | 0.431 | 0.037 | −0.394 |
| Aromatics: | | | |
| Benzene | 0.05 | 25.25 | 25.20 |
| Toluene | 91.69 | 42.03 | −49.66 |
| Ethylbenzene | 1.38 | 1.07 | −0.31 |
| p-Xylene | 0.53 | 4.94 | 4.41 |
| m-Xylene | 0.97 | 10.75 | 9.78 |
| O-Xylene | 0.11 | 5.05 | 4.94 |
| C9 + aromatics | 0 | 5.21 | 5.21 |
| Total | 99.998 | 99.998 | 0.008 |

$$\text{p-Xylene}\% = \frac{\text{p-Xylene} \times 100\%}{\text{p-Xylene} + \text{m-Xylene} + \text{o-Xylene}} = \frac{4.94 \times 100\%}{4.94 + 10.75 + 5.05} = 24\%$$

The analyses show that the toluene disproportionated to make benzene and xylenes, while nonaromatic impurities in the same boiling range were substantially eliminated by cracking to form light ends. Para-xylene comprised 24 wt % of the xylenes produced.

This example demonstrates the elimination of close boiling nonaromatics and the preparation of chemically pure benzene and xylene using a non-para-selective catalyst whereby only 24 wt % of the xylene fraction was para-xylene.

EXAMPLE 2

Aromatization Followed by Selectivated Para-Xylene Production

A $C_6$–$C_7$ naphtha was aromatized over a non-acidic platinum L-zeolite catalyst by being fed via line 10 (refer to FIG. 1) to an aromatization unit 12. The aromatization was run to maximize yield of benzene whereby the resulting liquid product contained only a small amount of unreacted $C_{7+}$ naphtha components. The $C_{6+}$ product stream was collected. It was then taken, as represented by line 14 and was separated in a distillation column 16 into a benzene-rich fraction (removed as represented by line 18) and a $C_{7+}$ bottoms fraction, both having close-boiling nonaromatics. Most of the unreacted paraffins, olefins and naphthenes were found in the benzene overhead fraction rather than the toluene and heavy aromatics $C_{7+}$ fraction after distillation. As a result the feed (bottoms fraction) to the toluene disproportionation step which followed contained about 0.4 wt % close boiling non-aromatics. The benzene fraction was sent as represented by line 37 to aromatics extraction unit 36.

The conditions during the aromatization process were as follows:

Naphtha WHSV=1.0, feed molar ratio $H_2$/naphtha=5.0, temperature=890° F., pressure=70 psig.

The $C_{7+}$ bottoms fraction, along with some of the hydrogen from the aromatization unit 12 introduced as represented by line 20, was fed via line 22 to a disproportionation zone 24 wherein it was contacted with a selectivated intermediate pore size zeolite catalyst whereby para-xylene was selectively produced and close boiling non-aromatics were converted to materials which boil generally outside of the benzene and xylene ranges. Excess hydrogen was removed from the aromatization unit 12 via line 25 and light hydrocarbons were removed via line 27. The toluene fraction was reacted over an acidic, large crystallite size (0.5–2.0) HZSM-5 (Silica to alumina ratio of 70:1) catalyst, which had previously been selectivated by passing toluene and nitrogen over the catalyst at 1100° F. and 150 psig for 27 hours. 12 mL/h of toluene feed and 75 CC—STP of hydrogen were passed over 2 grams of catalyst at 850° F. and 150 psig. Table 2 shows the analysis of the toluene fraction of the aromatization product and of the product of the selectivated conversion of toluene to benzene and para-xylene.

TABLE 2

Reaction of $C_7$ + Aromatization Product over Para-Selective Catalyst

| Composition, Wt % | Feed | Product | Difference |
|---|---|---|---|
| Light Ends | 0.00 | 0.71 | 0.71 |
| C6 non-aromatics | 0.00 | 0.00 | 0.00 |
| Benzene | 1.01 | 10.35 | 9.33 |
| C7 non-aromatics | 0.11 | 0.02 | −0.09 |
| Toluene | 83.79 | 68.36 | −15.42 |
| C8 + non-aromatics | 0.32 | 0.06 | −0.26 |
| Ethylbenzene | 1.57 | 0.32 | −1.25 |
| p-Xylene | 1.90 | 9.78 | 7.88 |
| m-Xylene | 1.86 | 3.02 | 1.16 |
| o-Xylene | 2.41 | 1.51 | −0.90 |
| Heavy aromatics | 7.02 | 5.86 | −1.16 |
| Total | 99.99 | 100.00 | 0.01 |

Catalyst: 'Selectivated Large Crystal HZSM-5'
Conditions:

TABLE 2-continued

| Reaction of $C_7$ + Aromatization Product over Para-Selective Catalyst | | | |
|---|---|---|---|
| Composition, Wt % | Feed | Product | Difference |

Catalyst Weight = 2.0 Grams
Liquid Feed Rate = 12 mL/h
$H_2$ Feed Rate = 75 cc/min
Temperature = 850° F.
Pressure = 150 psig $$\text{p-Xylene \%} = \frac{\text{p-Xylene} \times 100\%}{\text{p-Xylene} + \text{m-Xylene} + \text{o-Xylene}} = \frac{9.78 \times 100}{9.78 + 3.02 + 1.51} 68.3\%$$

Better than 80% of the close boiling non-aromatic material in the toluene fraction was converted to light or heavy ends in the toluene disproportionation reactor leaving only 0.02 wt % $C_7$ non-aromatics in the final product relative to 10.35 wt % benzene and 0.06 wt % $C_{8+}$ non-aromatics relative to 14.31 wt % xylenes. Thus the benzene stream has a purity of 99.8 wt %. About 80% of the ethylbenzene and a proportion of the ortho-xylene and heavy aromatics in the original feed were converted yielding even more benzene and para-xylene. The para-xylene proportion of the xylene fraction was 68.3 wt %.

Hydrogen and light hydrocarbons from the disproportionation zone 24 are recycled via line 29 to the aromatization unit 12. The rest of the product from the disproportionation zone 24 is conducted via line 26 to distillation column 28 where it is distilled to provide a bottom fraction having $C_{8+}$ aromatics and being enriched in para-xylene which is removed via line 30 and an overhead fraction containing $C_6$ and $C_7$ aromatics. The $C_{8+}$ aromatics stream is sent to a para-xylene plant for the recovery of para-xylene and the isomerization of ortho- and meta-xylenes to para-xylene. operating costs in the para-xylene plant are significantly reduced because the toluene disproportionation unit produces a xylene stream which 1) is substantially free of nonaromatics, 2) is rich in the para-xylene isomer and 3) contains a reduced amount of ethylbenzene.

The $C_6/C_7$ aromatics fraction is conducted via line 32 to a further distillation column 34 where it is further distilled to provide toluene for sending via line 31 to the disproportionation zone 24 (or for recovery as a chemically pure product) and to provide high purity benzene as an overhead. This benzene is combined via line 33 with the high purity benzene obtained from the aromatics extraction unit 36. The benzene product is chemically pure and the xylene product is substantially free of non-aromatics. The xylene product is enriched in para-xylene. The para-xylene proportion of the xylene fraction is 60 to 80 wt %.

This example demonstrates the production of high purity benzene and a para-enriched xylenes stream from a $C_6$–$C_7$ naphtha. The process comprises aromatization of a $C_6$–$C_7$ naphtha followed by para-selective disproportionation of impure toluene.

EXAMPLE 3

Process Starting with $C_7$ Naphtha

Figure 2:
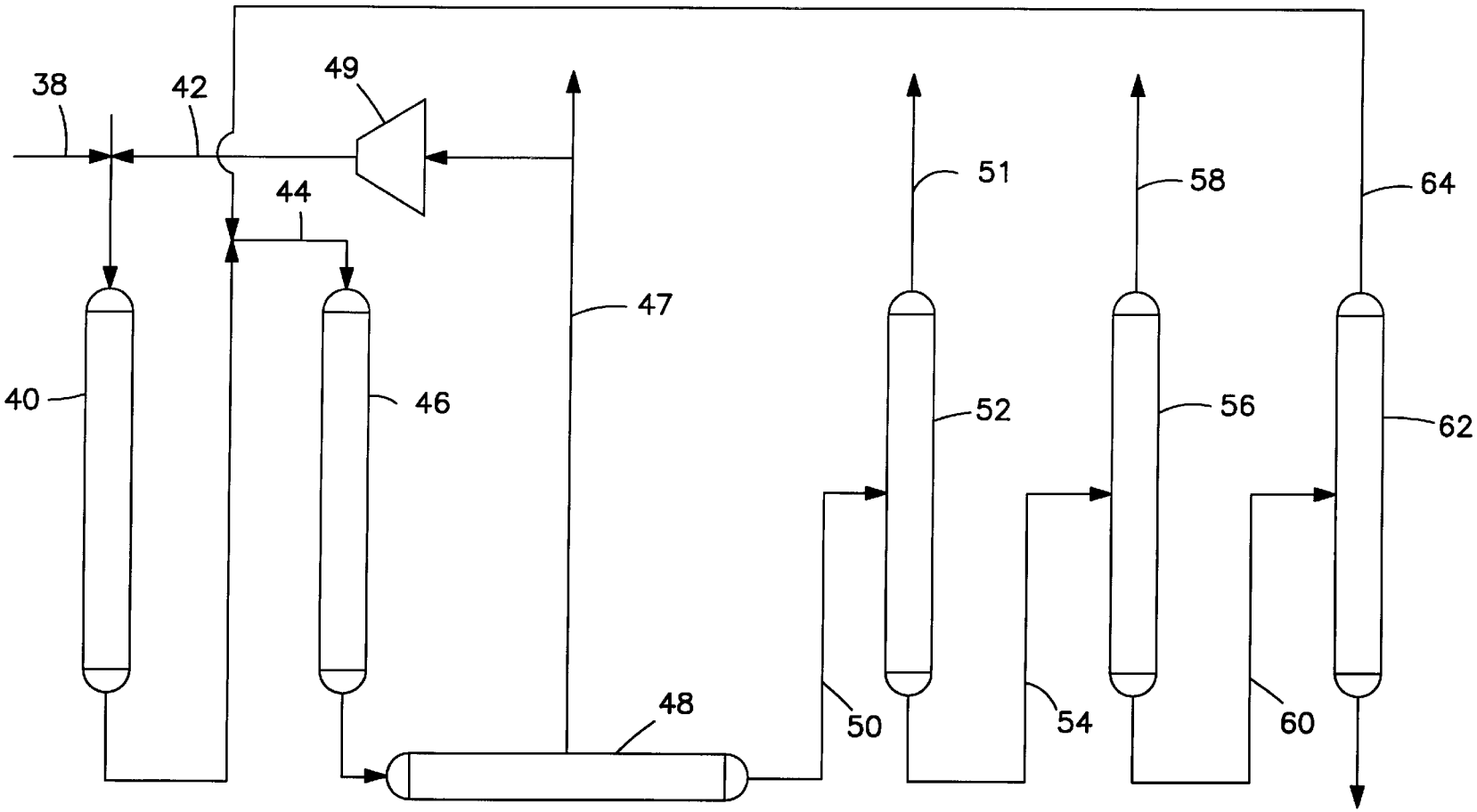
FIG. 2 illustrates, schematically, a process in accordance with another embodiment of the invention.

A $C_7$ naphtha is fed via line 38 (see FIG. 2) to an aromatization reactor 40 along with hydrogen gas which may be fed via line 42. The aromatics and close-boiling non-aromatics contained in the product from the reactor are fed via line 44 to a disproportionation zone 46 containing an acidic intermediate pore size zeolite catalyst which has been selectivated for para-xylene production. Hydrogen is separated from the product of the disproportionation zone 46 in flash drum 48 and removed via line 47. All or a portion of the hydrogen can be recycled, for example, via compressor 49, to the aromatization reactor 40 via line 42. The remainder of the product is fed via line 50 to a stabilizer column 52 wherein light hydrocarbons are stripped off and removed via line 51. The bottoms fraction from the stabilizer column is fed via line 54 to a benzene recovery column 56 wherein an overhead fraction of chemically pure benzene is removed via line 58. The bottoms fraction from the benzene recovery column contains $C_7$ and $C_{8+}$ aromatics and is substantially free of close-boiling nonaromatics. The bottoms fraction is fed via line 60 to a toluene recycle column 62 wherein toluene is removed as the overhead via line 64 and sent to the disproportionation zone 46 (or recovered as a chemically pure product). The bottom fraction from the toluene recycle column contains chemical grade $C_{8+}$ aromatics enriched in para-xylene. The para-xylene proportion of the xylene fraction is 60 to 80 wt %.

This example demonstrates high para-xylene yield with the product being of chemical grade quality starting with a $C_7$ naphtha.

EXAMPLE 4

Process Starting with $C_5$–$C_{11}$ Naphtha

Figure 3:
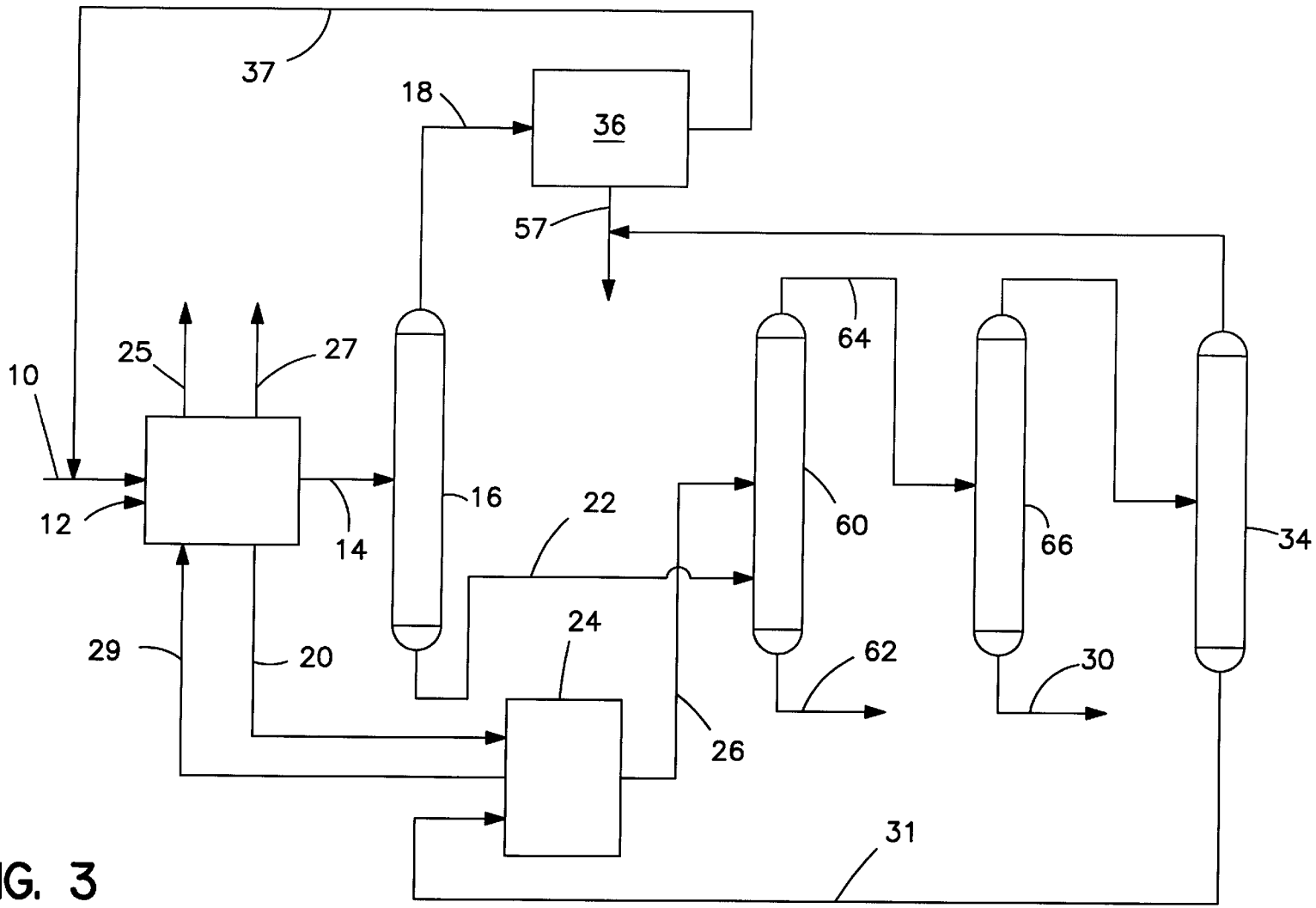
FIG. 3 illustrates, schematically, a process in accordance with still another embodiment of the invention.

FIG. 3 illustrates this example which is similar to the embodiment of FIG. 1. A $C_5$–$C_{11}$ full boiling range naphtha is fed to aromatization unit 12 via line 10. Hydrogen and light hydrocarbons are removed via lines 25 and 27. The remainder of the aromatization product is fed via line 14 to distillation column 16. The overhead from column 16 contains benzene and lighter components. It is fed to benzene extractor 36. The raffinate from extractor 36 is cycled to the aromatization unit 12 via line 37. A chemically pure benzene product is removed via line 57.

The bottoms fraction from column 16 is delivered via line 22 to a distillation column 60. $C_{9+}$ is removed from column 60 via line 62 and can be used as a heavy gasoline blending stock. The $C_6$–$C_8$ overhead from column 60 is led via line 64 to a further distillation column 66.

Distillation column 66 separates the $C_6$–$C_8$ overhead from column 60 into a $C_8$ product which is removed via line 30 and into a $C_6$–$C_7$ overhead which is further separated in distillation column 34 into chemically pure benzene and into toluene which is sent to disproportionation unit 24 via line 31 (or is recovered as chemically pure toluene). The chemically pure benzene from unit 34 is combined with the chemically pure benzene from unit 34. The toluene stream is disproportionated to yield chemically pure benzene, toluene and para-rich-xylenes. The toluene disproportionation product then proceeds to the distillation train via line 26 and high purity benzene, toluene and $C_8$ aromatics are removed as described above.

The above examples demonstrate the wide applicability of the process of the present invention for the production of para-xylene enriched xylenes along with high purity benzene from full boiling range naphthas and from toluene-rich feedstocks which can be prepared from such naphthas.

INDUSTRIAL APPLICABILITY

The present invention provides the capability of synthesizing chemical grade benzene and para-xylene enriched xylenes which are substantially free of close-boiling non-aromatics from toluene streams which include close-boiling non-aromatic impurities without the necessity for solvent extraction steps.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

That which is claimed is:

1. A process for the production of a benzene, toluene and xylene containing product which contains a reduced amount of close-boiling non-aromatics, comprising:

(a) aromatizing a predominantly paraffinic feedstock in an aromatization zone over a substantially nonacidic aromatization catalyst comprising a Group VIII metal on a molecular sieve support to produce an aromatization product which comprises a toluene containing feed which comprises at least about 70% toluene and from at least about 0.2 wt % to about 5 wt % close-boiling non-aromatics;

(b) contacting the toluene containing feed in a disproportionation zone with an acidic para-selective molecular sieve catalyst under conditions such that the product contains a reduced amount of close-boiling non-aromatics compared to the feed and such that at least 40% of the xylene produced is para-xylene; and (c) separating the product by distillation to recover at least benzene and xylene fractions, each of which contain less than 0.5 wt % close-boiling non-aromatic impurities.

2. A process as set forth in claim 1, wherein the contacting is carried out at a temperature between about 700° F. and about 1,200° F., at a toluene weight hourly space velocity between 0.1 and 10, in the presence of hydrogen at 30 to 1,000 psig pressure and with the catalyst having an n-hexane cracking activity corresponding to an $\alpha$ value of at least 10.

3. A process as set forth in claim 2, wherein the product contains less than 0.2 wt % close-boiling nonaromatics.

4. A process as set forth in claim 2, wherein the product contains less than 0.1 wt % close-boiling nonaromatics.

5. A process as set forth in claim 2, wherein the catalyst comprises an intermediate pore size zeolite.

6. A process as set forth in claim 5, wherein the catalyst comprises ZSM-5.

7. A process as set forth in claim 6, wherein the ZSM-5 has an average crystallite size of at least 0.5$\mu$ and a silica to alumina ratio between 10 and 100.

8. A process as set forth in claim 7, wherein the ZSM-5 is selectivated via depositing between about 1 wt % and 40 wt % of coke thereon.

9. A process as set forth in claim 1, wherein the aromatization is carried out at a temperature between 800° F. and about 1,100° F., a pressure between 0 and 200 psig and a hydrogen to paraffinic feedstock molar ratio of 0.1 to 10.

10. A process as set forth in claim 9, wherein the aromatization catalyst comprises platinum on L-zeolite.

11. A process as set forth in claim 9, wherein the paraffinic feedstock is a $C_6$–$C_7$ naphtha.

12. A process as set forth in claim 11, further including the steps of:

recovering a hydrogen stream, at least one $C_5$ and lighter hydrocarbon streams and a $C_6$+ hydrocarbon stream from the aromatization step;

separating the $C_6$+ stream into a benzene-rich fraction and a heavier fraction;

conducting the benzene-rich fraction to an aromatics extraction zone; and conducting the heavier fraction to the disproportionation zone.

13. A process as set forth in claim 12, including supplying hydrogen produced in the aromatization zone to the disproportionation zone and recycling hydrogen from the disproportionation zone to the aromatization zone.

14. A process as set forth in claim 9, wherein the paraffinic feedstock is a $C_7$ naphtha.

15. A process as set forth in claim 14, wherein at least a portion of the aromatization product is conducted to the disproportionation zone without an intermediate condensation or distillation step.

16. A process as set forth in claim 15, wherein hydrogen is recovered from the effluent of the disproportionation zone and recycled to the aromatization zone.

17. A process as set forth in claim 9, wherein the paraffinic feedstock comprises $C_7$–$C_{11}$ components.

18. A process as set forth in claim 17, including:

distilling the aromatization product to separate toluene from benzene and from xylenes and to produce a toluene fraction; and conducting the toluene fraction to the disproportionation zone.

19. A process as set forth in claim 8, wherein the paraffinic feedstock has less than 50 ppb by weight sulfur.

* * * * *